United States Patent [19]

Viehrig

[11] Patent Number: 4,842,179

[45] Date of Patent: Jun. 27, 1989

[54] WET PROCESSING ARRANGEMENT FOR PHOTOSENSITIVE MATERIAL

[75] Inventor: Wolfgang Viehrig, Munich, Fed. Rep. of Germany

[73] Assignee: Agfa-Gevaert Aktiengesellschaft, Leverkusen, Fed. Rep. of Germany

[21] Appl. No.: 171,153

[22] Filed: Mar. 17, 1988

Related U.S. Application Data

[63] Continuation of Ser. No. 848,727, Apr. 4, 1986, abandoned.

[30] Foreign Application Priority Data

Apr. 13, 1985 [DE] Fed. Rep. of Germany ..... 3513346

[51] Int. Cl.[4] ..... B65H 20/00

[52] U.S. Cl. ..... 226/108; 226/168; 226/188; 226/189; 226/194

[58] Field of Search ..... 226/173, 194, 119, 115, 226/117, 120, 108, 168, 188, 189, 91, 92; 242/65, 66; 354/321; 198/842, 837, 817

[56] References Cited

U.S. PATENT DOCUMENTS

| | | | |
|---|---|---|---|
| 1,495,678 | 5/1924 | de Ybarrondo | 354/321 |
| 4,068,250 | 1/1978 | Anderson et al. | 354/321 X |
| 4,239,367 | 12/1980 | Hope et al. | 354/321 X |
| 4,330,191 | 5/1982 | Rawlings et al. | 226/173 X |

FOREIGN PATENT DOCUMENTS 3143201 10/1984 Fed. Rep. of Germany .

*Primary Examiner*—Lenard A. Footland
*Assistant Examiner*—John M. Eghtessad
*Attorney, Agent, or Firm*—Peter K. Kontler

[57] ABSTRACT

An arrangement for wet processing webs of photographic paper includes a housing, a set of parallel driven shafts mounted in an upper portion of the housing, and a set of parallel driven shafts mounted in the lower portion of the housing. Each shaft carries first web-contacting rollers on its end portions and a group of second web-contacting rollers on its central portion. A band-engaging roller is arranged between each first roller and the corresponding group of second rollers. A first conveyor band is trained over the set of band-engaging rollers nearest one end of the respective shafts while a second conveyor band is trained over the set of band-engaging rollers nearest the other end of the respective shafts. The conveyor bands are provided with gripping elements which clamp webs of photographic paper entering the housing so that the conveyor bands can draw the webs through the housing. Each shaft is rotatably supported by a pair of bearing units located in the regions of the respective band-engaging rollers. The bearing units for the upper shafts support the latter from below while the bearing units for the lower shafts support such shafts from above.

25 Claims, 2 Drawing Sheets

WET PROCESSING ARRANGEMENT FOR PHOTOSENSITIVE MATERIAL

This application is a continuation, of application Ser. No. 848,727, filed Apr. 4, 1986, abandoned.

BACKGROUND OF THE INVENTION

The invention relates generally to an arrangement for processing running lengths of photosensitive material.

More particularly, the invention relates to a tank which accommodates a processing bath, e.g., a fixing or developing bath, for running lengths of photographic material or to a rack which can be removably installed in such a tank.

A known arrangement for wet processing running lengths of photographic material, e.g., running webs of photographic paper, comprises a housing, and a series of shafts mounted in the housing. A multiplicity of rollers for guiding the photographic material through the housing is mounted on each of the shafts. The shafts are arranged in such a manner that the photographic material follows a meandering or tortuous path through the housing. At least two of the rollers on each shaft have respective conveyor bands trained about the same, and the conveyor bands serve to advance the photographic material through the housing. Each of the band-engaging rollers is disposed between a pair of web-contacting rollers which engage and guide one or more webs or lengths of photographic material being drawn through the housing by the conveyor bands. The arrangement is capable of simultaneously processing several running lengths of photographic material having different widths.

An arrangement of the type outlined above is disclosed, for example, in the West German Pat. No. 31 43 201. Here, each of the web-contacting rollers is mounted on the respective shaft via a spring-loaded, automatic coupling designed in such a manner that the associated roller can rotate relative to its shaft as long as the tension in the length of photographic material being guided by the roller is below a predetermined value. When the tension in the photographic material becomes excessive, that is, exceeds the predetermined value, the roller is urged towards the shaft against the action of the springs in the coupling. The roller is thus automatically coupled to the shaft which then begins to drive the roller. The speed of rotation of the shaft exceeds the speed of advance of the photographic material which is now drawn into the housing at a rate greater than that at which it is drawn out of the housing. As a result, slack develops in the running length of photographic material and the tension is reduced. Once the tension falls below the predetermined value, the springs in the coupling urge the roller away from the shaft so that the roller becomes uncoupled and again functions as an idler roller.

The shafts are subjected to bending stresses which cause the shafts to bend. Since the bending stresses in a shaft vary longitudinally of the latter, the amount of deflection of the shaft likewise varies longitudinally of the shaft. This can cause the lengths of photographic material to shift laterally so that the photographic material is no longer transported properly. In order to compensate for the varying deflection of the shaft, the spring constants of the couplings in the arrangement of the West German patent are different at different locations of a shaft. The web-contacting rollers are accordingly displaced towards the respective shaft by different amounts when the tension in the lengths of photographic material increases beyond the predetermined value. The spring constants are selected in such a manner that the differences between the displacements of the web-contacting rollers on a shaft compensate for the varying deflection of the shaft.

A drawback of the arrangement disclosed in the West German patent is that the use of couplings having different spring constants increases the complexity and cost of the arrangement.

Furthermore, the width of the known arrangement is limited which, in turn, limits the number of lengths of photographic material that can be processed at one time. This is due to the fact that, when the width of the arrangement is increased beyond a certain point, the use of couplings having different spring constants is no longer sufficient to compensate for varying deflection of a shaft. The reason is as follows: In the arrangement of the West German patent, the photographic material is secured to the conveyor bands via clamps which are perpendicular to the direction of advance of the photographic material. A relatively large prestress exists and it has been found that, due to this prestress, the band-engaging rollers are subjected to forces up to ten times as great as those which act on the web-contacting rollers. The forces acting on the band-engaging rollers tend to urge the uppermost band-engaging rollers in the housing downwards and the lowermost band-engaging rollers upwards. In order to maximize the number of lengths of photographic material which can be processed at one time, it is necessary to place the band-engaging rollers between the web-contacting rollers. However, this increases the distance, and hence the moment arms, between the band-engaging rollers of a shaft and the bearings of the respective shaft. Consequently, the shaft is deflected to such an extent that even the use of couplings having different spring constants is unable to fully compensate for the deflection. This means that the web-contacting rollers assume and maintain inclined positions thereby leading to lateral shifting of the lengths of photographic material.

Certain apparatus have fixed shafts. In such apparatus, each roller is mounted on the respective shaft so as to be freely rotatable relative thereto under all circumstances, i.e., the shafts and the rollers are devoid of means for establishing connections between the same. Certain other apparatus are designed so that all rollers on a driven shaft are fixed to the shaft for rotation therewith. In both types of apparatus, compensation for varying deflection of a shaft evidently cannot be accomplished by means of spring-loaded couplings.

In those situations where it is not possible to compensate for varying deflection of a shaft via spring-loaded couplings, current practice is to substantially increase the diameter of the shaft, e.g., from 20 mm to 25 mm. The increased diameter reduces the variations in the deflection of the shaft. However, since the shafts in an arrangement for the wet processing of photographic materials must be composed of high-priced stainless steel, an increase in shaft diameter greatly increases the cost of the arrangement. Moreover, an increase in shaft diameter considerably increases the weight of the arrangement. This is particularly unfavorable when the arrangement takes the form of a rack which is removably installed in a processing bath because the rack becomes heavy and therefore difficult to exchange.

OBJECTS AND SUMMARY OF THE INVENTION

It is an object of the invention to provide a processing arrangement for photosensitive material which makes it possible to reduce deflection of a shaft without an increase, and even upon a decrease, in shaft diameter.

Another object of the invention is to provide a processing arrangement for photosensitive material which enables variations in deflection of a shaft to be reduced to such an extent that the need for spring-loaded couplings having different spring constants is eliminated.

An additional object of the invention is to provide a processing arrangement which can be designed with an increased width to thereby increase the number of running lengths of photosensitive material which can be processed at one time but yet allows shaft deflection to be reduced without an increase in shaft diameter.

A further object of the invention is to provide a processing arrangement which permits running lengths of photosensitive material to be advanced in an orderly fashion without an increase in shaft diameter and without the use of springloaded couplings having different spring constants.

The preceding objects and others are achieved by the invention.

One aspect of the invention resides in an arrangement for processing running lengths of photosensitive material. The arrangement comprises support means, and at least one shaft. A multiplicity of rollers is mounted on the shaft for guiding the running lengths of photosensitive material. The rollers include a pair of first rollers, and a plurality of second rollers arranged so that each of the first rollers is disposed between two of the second rollers. Bearing means for the shaft is mounted on the support means and comprises a pair of bearing units each of which supports the shaft in the region of a respective first roller.

The arrangement of the invention is particularly well-suited for the wet processing of photosensitive material such as photographic paper. Several parallel running lengths of photosensitive material may be processed simultaneously using the arrangement, and the various lengths of photosensitive material may have different widths.

A conveyor band for advancing the photosensitive material may be trained over each of the first rollers. The conveyor bands may be provided with gripping means for entraining the photosensitive material.

The arrangement preferably comprises a multiplicity of shafts each of which carries a pair of first rollers, and a plurality of second rollers arranged in such a manner that a first roller is disposed between two second rollers. The shafts are advantageously arranged so as to define a meandering or tortuous path for the photosensitive material. Each of the first rollers on a shaft may cooperate with at least one of the first rollers on each other shaft, and a conveyor band for advancing the photosensitive material may be trained over each set of cooperating rollers. As mentioned above, the conveyor bands may be provided with gripping means for entraining the photosensitive material. Each of the shafts is supported by a pair of bearing units, and each bearing unit is located in the region of a first or band-engaging roller.

The bearing structure in accordance with the invention supports the shafts at or near the locations where the greatest forces arise. These forces accordingly generate no significant bending moments so that undesired bending or deflection of the shafts due to the forces acting on the conveyor bands may be virtually completely eliminated. As a result, the arrangement of the invention may simultaneously convey the same number of lengths of photosensitive material as, or a larger number of lengths than, the arrangements of the prior art with no increase in shaft diameter. In fact, the shaft diameter in the arrangement according to the invention may even be reduced. Thus, if a conventional processing arrangement has a shaft diameter of approximately 20 mm and the bearing structure of the invention is incorporated in such arrangement, the shaft diameter may, for example, be reduced to 15 mm. This allows substantial material and weight savings to be realized.

The shafts and the second or web-contacting rollers may be provided with spring-loaded couplings which couple the shafts and the web-contacting rollers to one another in automatic response to an increase in tension of the photosensitive material above a predetermined value and which automatically disengage the shafts and the web-contacting rollers when the tension decreases below the predetermined value. In the processing arrangements of the prior art, the various couplings for a given shaft are designed with different spring constants in order to compensate for varying deflection along the shaft. The different couplings may, for example, be differently colored to distinguish the couplings from one another. The bearing structure in accordance with the invention, on the other hand, brings with it the great advantage that the automatically engageable and disengageable spring-loaded couplings between a shaft and its web-contacting rollers need not have different spring constants. This makes it possible to reduce the number of different types of couplings and to simplify mounting and support of the shafts and/or rollers.

The support means which carries the bearing units for the shafts may comprise a housing which accommodates at least one processing bath for the photosensitive material or a housing of a portable rack designed to be removably immersed in a processing bath. Such a housing generally includes a pair of walls which are spaced longitudinally of the shafts and are disposed in the regions of the ends of the shafts.

In conventional processing arrangements having rotatable shafts, a chain drive for the shafts is mounted on one of the walls and comprises a plurality of drive elements, e.g., sprockets, each of which is connected with one end of a respective shaft. Since the shaft ends in the processing arrangements of the prior art are disposed in bearings and thus have support, there is no problem in fixing the shaft ends to the drive elements. The shaft ends in the processing arrangement of the invention, on the other hand, are overhung or cantilevered, that is, are freely suspended. Accordingly, it was anticipated that difficulties would arise if the shaft ends were connected with drive elements for the shafts, e.g., with sprockets constituting part of a conventional chain drive. However, contrary to expectation, it has been found that none of the shafts in the processing arrangement of the invention is subjected to excessive forces, or is loaded unsymmetrically about its center, when one of its ends is connected with a known chain drive mounted on a wall of the housing.

The shafts in the arrangement according to the invention may define a tortuous or meandering path in that certain of the shafts are disposed in an upper portion of the housing while one or more shafts are disposed in a lower portion of the housing such that each lower shaft is located between a pair of upper shafts. The conveyor bands here engage the upper band-engaging rollers from above and the lower band-engaging rollers from below so that the upper band-engaging rollers are urged downwards and the lower band-engaging rollers are urged upwards. Accordingly, it is necessary to support the upper shafts against downward displacement and the lower shafts against upward displacement.

In a conventional processing arrangement having upper and lower shafts situated in the manner just described, there is little problem in supporting the upper and lower shafts against downward and upward displacement. The reason is that the bearing units are located at the ends of the shafts and therefore outside of the range of the conveyor bands and the running lengths of photosensitive material. The bearing units can accordingly be designed at will to permit ready insertion of the shafts and rollers in, and ready removal of the shafts and rollers from, the housing for cleaning or replacement of the shafts, rollers and/or housing.

In the arrangement of the invention, however, the bearing units are shifted away from the ends of the shafts and into the range of the conveyor bands, as well as into the range of the running lengths of photosensitive material which extend to either side of a conveyor band. This poses the problem of designing the bearing units so as not to interfere with movement of the conveyor bands and photosensitive material while nevertheless permitting ready insertion of the shafts and rollers in, and ready removal of the shafts and rollers from, the housing for cleaning or replacement of the shafts, rollers and/or housing. According to the invention, this is achieved by supporting the upper shafts from below and the lower shafts from above. In a preferred embodiment of the invention, each upper bearing unit comprises an upwardly facing U-shaped portion which is engaged by the respective upper shaft and receives one of the band-engaging rollers of such shaft. The U-shaped portions terminate below the upper surfaces of the upper band-engaging rollers. Similarly, each lower bearing unit comprises a downwardly facing U-shaped portion which supports the respective lower shaft and receives one of the band-engaging rollers of the latter. The U-shaped portions here terminate above the lower surfaces of the lower band-engaging rollers.

The novel features which are considered as characteristic of the invention are set forth in particular in the appended claims. The improved processing arrangement itself, however, both as to its construction and its mode of operation, together with additional features and advantages thereof, will be best understood upon perusal of the following detailed description of certain specific embodiments with reference to the accompanying drawings.

DESCRIPTION OF THE PREFERRED EMBODIMENTS

Figure 1:
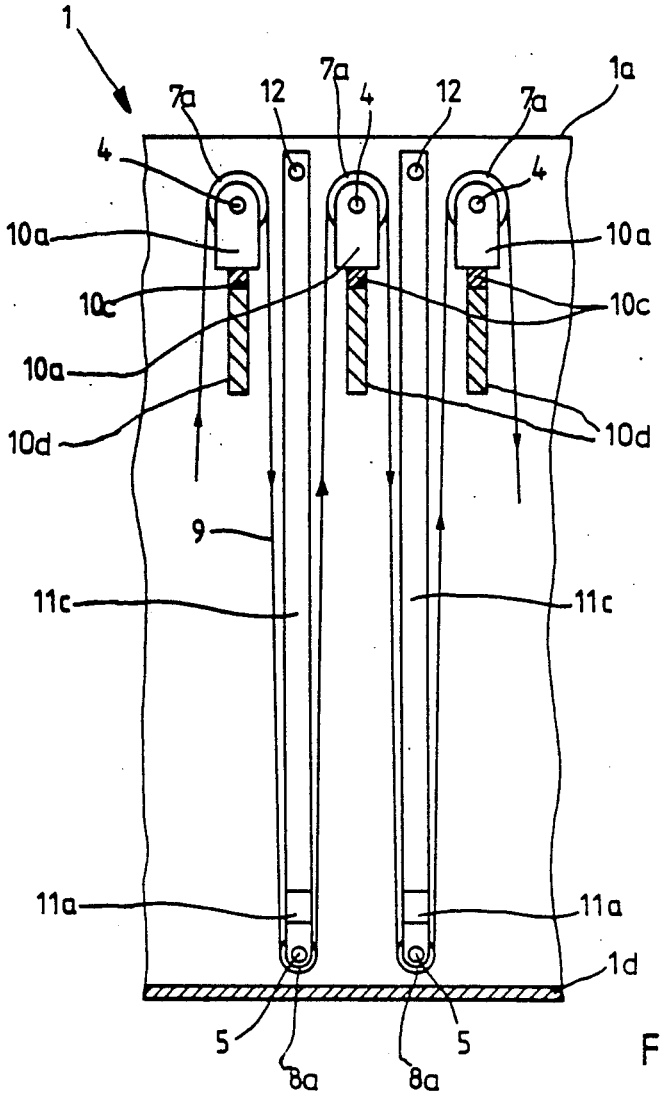
FIG. 1 is a fragmentary cross-sectional side view of an arrangement according to the invention for the wet processing of running lengths of photosensitive material.
Figure 2:
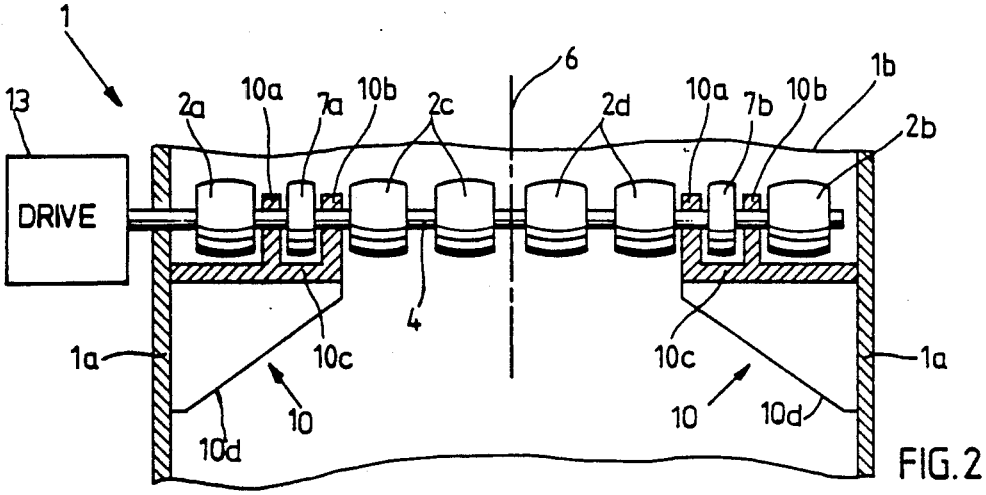
FIG. 2 is a fragmentary cross-sectional front view of an upper portion of the arrangement of FIG. 1 as seen in a first vertical plane normal to the plane of FIG. 1.
Figure 3:
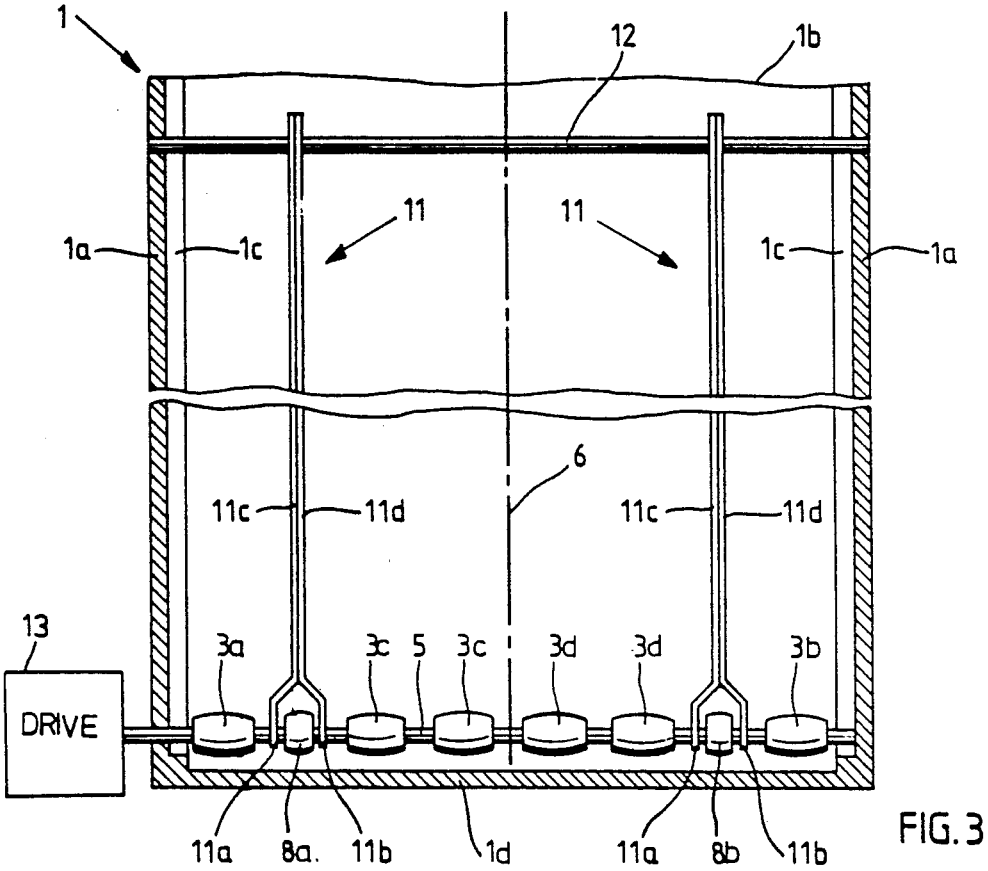
FIG. 3 is a fragmentary cross-sectional front view of upper and lower portions of the arrangement of FIG. 1 as seen in a second vertical plane normal to the plane of FIG. 1.

FIGS. 1–3 illustrate an arrangement in accordance with the invention for wet processing running lengths or webs of photosensitive material, e.g., running lengths or webs of photographic paper. The photosensitive material entering the processing arrangement may be in the form of flat, elongated strips or bands or in the form of strips or bands which have been convoluted into rolls. The arrangement is capable of processing several lengths of photosensitive material at one time, and such lengths are advanced through the arrangement parallel to one another. The various lengths of photosensitive material undergoing processing at the same time may have different widths.

The processing arrangement includes a housing or support 1 having a pair of spaced, upright side walls 1*a;* a pair of spaced, upright end walls 1*b* which are perpendicular to the side walls 1*a;* and a bottom wall 1*d*. The walls 1*a*, 1*b*, 1*d* cooperate to define a processing chamber in the housing 1.

The processing arrangement may constitute part of a processing station or apparatus for the photosensitive material. The housing 1 then accommodates one or more processing baths, e.g., a fixing bath and/or a developing bath, through which the photosensitive material is advanced. On the other hand, the processing arrangement may be in the form of a portable rack which is designed to be transported to and from a processing station and to be removably immersed in a processing bath for the photosensitive material.

As best seen in FIG. 1, a set of spaced, parallel shafts 4 is mounted in the upper portion of the housing 1. A second set of spaced, parallel shafts 5 is mounted in the lower portion of the housing 1. The upper shafts 4 are offset relative to the lower shafts 5 as considered in a direction transverse to the shafts 4,5 and a lower shaft 5 is disposed between each pair of upper shafts 4. The shafts 4,5 are perpendicular to the side walls 1*a*.

FIGS. 2 and 3 show that each of the shafts 4,5 has a pair of end portions which are respectively located in the regions of the two side walls 1*a*. The shafts 4,5 are driven in rotation and, to this end, one end portion of each shaft 4,5 is connected with a drive or drive element 13. The drive elements 13 may, for example, be in the form of sprockets constituting part of a conventional chain drive. In the event that the processing arrangement constitutes a portable rack, the drive elements 13 may be mounted on the housing 1.

The housing 1 and shafts 4,5 have a common central or symmetry plane 6 which is normal to the shafts 4,5 and the end walls 1*b*. Each of the shafts 4 carries a pair of rollers 2*a* and 2*b* which are symmetrically disposed with reference to the plane 6 and are mounted on the end portions of the respective shaft 4. Each of the shafts 4 further carries a second pair of rollers 2*c* and a third pair of rollers 2*d* which are disposed between the rollers 2*a* and 2*b*. The pair of rollers 2*c* is symmetrically arranged with reference to the pair of rollers 2*d* about the plane 6.

Each of the shafts 5 supports a pair of rollers 3*a* and 3*b* which are symmetrically disposed with reference to the plane 6 and are mounted on the end portions of the respective shaft 5. Each of the shafts 5 also supports a second pair of rollers 3*c* as well as a third pair of rollers 3*d*. The pair of rollers 3*c* is symmetrically arranged with reference to the pair of rollers 3*d* about the plane 6.

The rollers 2a–2d and 3a–3d may be mounted on the shafts 4,5 via conventional, spring-loaded couplings which have not been illustrated to preserve clarity. Such couplings are designed so that the rollers 2a–2d, 3a–3d are rotatable relative to the shafts 4,5 as long as the tension in the photosensitive material is below a predetermined value. Under these circumstances, the rollers 2a–2d, 3a–3d function as idler rollers. When the tension in the photosensitive material increases above the predetermined value, the couplings yield elastically thereby causing the rollers 2a–2d, 3a–3d to be brought into driving engagement with the shafts 4,5. The rollers 2a–2d, 3a–3d are then driven by the shafts 4,5 until the tension in the photosensitive material drops below the predetermined value at which time the couplings are urged to their original positions and the rollers 2a–2d, 3a–3d are disengaged from the shafts 4,5. The couplings thus cause the rollers 2a–2d, 3a–3d to be engaged with and disengaged from the shafts 4,5 in automatic response to changes in tension of the photosensitive material. Inasmuch as the rollers 2a–2d, 3a–3d are not permanently coupled to the shafts 4,5, the rollers 2a–2d, 3a–3d are considered to be idler rollers.

An additional pair of rollers 7a and 7b is mounted on each shaft 4. The roller 7a is located between the roller 2a and the roller pair 2c while the roller 7b is located between the roller 2b and the roller pair 2d. The rollers 7a, 7b are symmetrically arranged with reference to one another about the plane 6. Contrary to the rollers 2a–2d, the rollers 7a,7b are permanently fixed to the shaft 4 for rotation therewith.

Similarly, each shaft 5 supports an additional pair of rollers 8a and 8b. The roller 8a is disposed between the roller 3a and the roller pair 3c whereas the roller 8b is disposed between the roller 3b and the roller pair 3d. The rollers 8a,8b are symmetrically arranged relative to each other about the plane 6. In contrast to the rollers 3a–3d, the rollers 8a,8b are permanently secured to and rotatable with the shaft 5.

The rollers 7a,8a together constitute a first set of cooperating conveying rollers, and the rollers 7b,8b together constitute a second set of cooperating conveying rollers. A first conveyor band or belt 9 is trained over and driven by the set of driven rollers 7a,8a and a second conveyor band or belt 9 is trained over and driven by the set of driven rollers 7b,8b. Only one of the conveyor bands 9 is illustrated in order to preserve clarity and may be seen in FIG. 1. The conveyor bands 9, which are endless, travel through the housing 1 in the direction indicated by the arrowheads.

The rollers 2a–2d,7a,7b on each upper shaft 4 are arranged in a row, and the rows of upper rollers 2a–2d-,7a,7b extend in parallelism with one another. Similarly, the rollers 3a–3d,8a,8b on each lower shaft 5 are arranged in a row which in parallel to the remaining row or rows of lower rollers 3a–3d, 8a,8b. The rollers 2a–2d-,7a,7b and 3a–3d,8a,8b function to guide and convey the webs of photosensitive material through the housing 1, and the shafts 4,5 are arranged in such a manner that the rows of upper rollers 2a–2d,7a,7b and the rows of lower rollers 3a–3d,8a,8b together define a meandering or tortuous path for the photosensitive material travelling through the housing 1. Although the photosensitive material is not illustrated for the sake of clarity, the meandering or tortuous path is shown by the conveyor band 9 in FIG. 1 which follows the same path in the housing 1 as the photosensitive material.

When a web of photosensitive material to be processed is conveyed into the processing arrangement, it is clamped by gripping elements which are provided on the conveyor bands 9 and are again not illustrated to preserve clarity. The gripping elements, which are conventional, project from the conveyor bands 9 in a direction normal to the direction of travel of the conveyor bands 9 and the photosensitive material. The conveyor bands 9 operate to draw the photosensitive material around the rows of rollers 2a–2d, 7a,7b and 3a–3d,8a,8b and through the housing 1.

As mentioned earlier, the processing arrangement is capable of accommodating several parallel running webs of photosensitive material at the same time. To this end, each of the conveyor bands 9 is designed to grip and transport two webs of photosensitive material. Thus, by way of example, a first relatively narrow web of photosensitive material may be guided around the set of outer rollers 2a,3a while a second relatively narrow web of photosensitive material is simultaneously guided around the set of outer rollers 2b,3b. At the same time, a first wider web of photosensitive material may be drawn around the roller pairs 2c,3c and a second wider web of photosensitive material drawn around the rollers 2d,3d. Instead of guiding one web of photosensitive material around the roller pairs 2c,3c and another web around the roller pairs 2d,3d, it is possible to draw a single, very wide web of photosensitive material around all four rollers 2c,2d of each shaft 4 and all four rollers 3c,3d of each shaft 5. It is further possible to replace the roller 2c,2d of each shaft 4, as well as the roller 3c,3d of each shaft 5, with an uneven number of rollers and to again guide a single, very wide web photosensitive material around such rollers.

The rollers 7a,7b,8a,8b engage and support the conveyor bands 9 and may thus be referred to as band-engaging rollers. Similarly, since the rollers 2a–2d, 3a–3d contact and support the web or webs of photosensitive material travelling through the housing 1, the rollers 2a–2d, 3a–3d may be referred to as web-contacting rollers.

In FIGS. 1–3, it is assumed that the shafts 4,5 are rotatably mounted; the rollers 7a, 7b,8a,8b are secured to the shafts 4,5 for rotation therewith; and the rollers 2a–2d, 3a–3d are mounted on the shafts 4,5 by means of couplings which automatically engage the rollers 2a–2d, 3a–3d with and automatically disengage the rollers 2a–2d, 3a–3d from the shafts 4,5. However, other types of mounting structures may be used. For instance, the shafts 4,5 may be fixed and the rollers 2a–2d, 7a,7b, 3a–3d,8a,8b may all be in the form of permanent idler rollers, that is, rollers which are always rotatable relative to the respective shafts 4,5. It is further possible for the shafts 4,5 to be rotatable and for each of the rollers 2a–2d,7a,7b,3a–3d,8a,8b to be mounted on the respective shaft 4 or 5 for rotation therewith. Another possibility is for the shafts 4,5 to be rotatably mounted and for the rollers 7a,7b, 8a,8b to be in the form of permanent idler rollers while the rollers 2a–2d, 3a–3d are mounted on the respective shafts 4,5 via spring-loaded couplings.

As webs of photosensitive material enter the processing arrangement, they are gripped by the clamping elements on the conveyor bands 9 and drawn around the upper rollers 2a–2d,7a,7b and the lower rollers 3a–3d,8a,8b in the direction indicated by the arrowheads in FIG. 1. Accordingly, the upper rollers 2a–2d-,7a,7b are subjected to a substantial downward force while the lower rollers 3a–3d,8a,8b are subjected to a substantial upward force. When the tension in the webs of photosensitive material, and hence the force on the rollers 2a–2d,7a,7b and the rollers 3a–3d,8a,8b, exceeds a predetermined value, the spring-loaded couplings between the web-contacting rollers 2a–2d,3a–3d and the respective shafts 4,5 yield. The rollers 2a–2d,3a–3d are then coupled to the respective shafts 4,5 which begin to drive the rollers 2a–2d,3a–3d. The latter, in turn, now exert a conveying force on the photosensitive material thereby causing the photosensitive material to be drawn into the housing 1 at a rate exceeding the rate of withdrawal of the photosensitive material from the housing 1. Consequently, slack develops in the photosensitive material so that the tension therein is reduced. Once the tension falls below the predetermined value, the springs in the couplings urge the couplings to their original positions. The rollers 2a–2d,3a–3d are thus automatically disengaged from the respective shafts 4,5. The tension in the photosensitive material subsequently begins to increase again and the cycle repeats itself.

The downward force on the upper rollers 2a–2d-,7a,7b generates a moment which causes the shafts 4 to bend downwards. Similarly, the upward force on the lower rollers 3a–3d,8a,8b generates a moment which causes the shafts 5 to bend upwards. The magnitude of the bending moment, and hence the magnitude of shaft deflection, due to any given roller increases with increasing distance of the roller from the bearings which support the respective shaft 4,5.

In conventional processing arrangements of the type illustrated in FIGS. 1–3, the shafts are rotatably supported at their ends and are driven by means of a chain drive. It has been found that the forces on the band-engaging rollers of such processing arrangements are approximately ten times as large as the forces on the web-contacting rollers. As a result, the shafts have a substantial inclination to the horizontal at the locations of virtually all web-contacting rollers. This inclination, which leads to lateral shifting of the photosensitive material, has until now been partially compensated for by employing spring-loaded couplings with different spring constants for the various web-contacting rollers of a shaft. However, the use of different couplings for the different web-contacting rollers of a shaft is disadvantageous because it increases the complexity and the cost of the processing arrangement. Furthermore, no compensation for shaft deflection is possible when all of the rollers are fixed to the respective shafts for rotation therewith or when the rollers are permanently rotatable relative to the respective shafts. In such situations, it has heretofore been necessary to increase the shaft diameter in order to prevent shaft deflection in the first place. This increases both the cost and the weight of the processing arrangement.

To reduce or eliminate undesired downward and upward deflection of the respective shafts 4,5 without an increase in shaft diameter and without the employment of couplings with different spring constants for the various web-contacting rollers 2a–2d,3a–3d of a shaft 4,5, the shafts 4,5 in the processing arrangement of the invention are supported in such a manner that the end portions of the shafts 4,5, and hence the web-contacting rollers 2a,2b,3a,3b carried at the end portions, are mounted in an overhung or cantilever fashion. Thus, in contrast to the processing arrangements of the prior art where the shafts are rotatably supported at their end portions, the shafts 4,5 are rotatably supported at locations inwardly of their end portions. Specifically, the upper shafts 4 are rotatably supported in the regions of the respective band-engaging rollers 7a,7b while the lower shafts 5 are rotatably supported in the regions of the respective band-engaging rollers 8a,8b.

Each of the upper shafts 4 is rotatably mounted in a pair of bearing units 10 which support the respective shaft 4 from below. Each of the bearing units 10 comprises a flange or bracket 10d which is fast with one of the side walls 1a of the housing 1 and projects to the interior of the latter. If the walls 1a are composed of a synthetic resin, the brackets 10d are preferably formed of one piece with the walls 1a. The brackets 10d of the bearing units 10 which engage the shafts 4 in the regions of the rollers 7a are mounted on the side wall 1a nearest these rollers while the brackets 10d of the bearing units 10 which engage the shafts 4 in the regions of the rollers 7b are mounted on the side wall 1a nearest the rollers 7b. The brackets 10d are disposed at a level below the rollers 7a,7b, and the end of each bracket 10d remote from the respective side wall 1a is provided with a portion 10c having a U-shaped cross section. The U-shaped portion 10c of each bearing unit 10 has a pair of spaced, upwardly projecting legs 10a and 10b, and the legs 10a,10b of the bearing units 10 for the rollers 7a are located on opposite sides of such rollers whereas the legs 10a,10b of the bearing units 10 for the rollers 7b are similarly located on opposite sides of the rollers 7b. The legs 10a,10b may be provided with registering passages through which the shafts 4 are passed and then secured against lateral movement. With this type of construction, the rollers 2a–2d,7a,7b must be mounted on the shafts 4 at the time that these are inserted in the passages of the legs 10a,10b, that is, the rollers 2a–2d,7a,7b must be aligned with the passages prior to insertion of the shafts 4 therein so that the shafts 4 can be passed through the rollers 2a–2d,7a,7b as the shafts 4 are passed through the passages. Alternatively, the upper ends of the legs 10a,10b may be provided with upwardly open cutouts. This makes it possible to mount the rollers 7a,7b as well as the rollers 2a–2d and the associated spring-loaded couplings, on the shafts 4 and to then insert the latter in the arms 10a,10b from above.

The arms 10a,10b terminate at a level below that of the upper surfaces of the rollers 2a–2d,7a,7b. Since the bearing units 10 rotatably support the shafts 4 from below and terminate short of the upper surfaces of the rollers 2a–2d,7a,7b, the bearing units 10 neither contact nor interfere with movement of the conveyor bands 9 and the photosensitive material which pass over the upper surfaces of the rollers 2a–2d,7a,7b.

Each of the lower shafts 5 is rotatably mounted in a pair of bearing units 11 which support the respective shaft 5 from above in the regions of the driven rollers 8a,8b. Each bearing unit 11 comprises a pair of narrow, elongated strips 11c, and 11d which extend from the upper portion to the lower portion of the housing 1. The strips 11c,11d of a respective bearing unit 11 are in surface-to-surface engagement along the span from the upper portion of the housing 1 to a point just above the roller 8a or 8b supported by the bearing unit 11. At this point, the strips 11c,11d are bent away from one another to define an inverted, generally U-shaped section having a pair of spaced, downwardly extending arms 11a and 11b. The arms 11a,11b of the bearing units 11 for the rollers 8a are located on opposite sides of such rollers while the arms 11a,11b of the bearing units 11 for the rollers 8b are likewise located on opposite sides of the rollers 8*b*. The arms 11*a*,11*b* of the bearing units 11 for each shaft 5 are provided with registering passages which receive the respective shaft 5.

The arms 11*a*,11*b* terminate at a level above the lower surfaces of the rollers 3*a*–3*d*,8*a*,8*b*. Since the bearing units 11 rotatably support the shafts 5 from above and terminate short of the lower surfaces of the rollers 3*a*–3*d*,8*a*,8*b*, the bearing units 11 neither contact nor interfere with movement of the conveyor bands and the photosensitive material which pass around the lower surfaces of the rollers 3*a*–3*d*,8*a*,8*b*.

The bearing units 11 for each shaft 5 are suspended from a carrier 12 in the form of a rod, and the upper ends of the strips 11*c*,11*d* are provided with openings which receive the respective rod 12. The rods 12 are disposed in the upper portion of the housing 1 and extend in parallelism with the shafts 4,5. Each of the rods 12 is located between a pair of upper shafts 4 and is thus arranged directly above the lower shaft 5 supported by the bearing units 11 on the respective rod 12. The rods 12 are mounted on the walls 1*a* of the housing 1.

The walls 1*a* of the housing 1 are advantageously provided with vertically extending grooves 1*c* which receive the end portions of the lower shafts 5 with a small amount of play. The grooves 1*c* function to guide the shafts 5, particularly during insertion of the shafts 5 into the housing 1.

The bearing structure in accordance with the invention has the advantage that the bearing units 10,11 do not interfere with insertion of the shafts 4,5 and the rollers 2*a*–2*d*,7*a*,7*b*,3*a*–3*d*,8*a*,8*b*, into, and removal of the same from, the housing 1. Furthermore, the bearing units 11 for the lower shafts 5 not only serve to hold the latter but also to inhibit upward bending of the shafts 5. Since the bearing units 10,11 are disposed at those locations where the shafts 4,5 are subjected to the greatest forces transverse to their axes, bending of the shaft diameters are small. Moreover, inasmuch as each bearing unit 10,11 is situated opposite that side of the respective set of rollers 2*a*–2*d*,7*a*,7*b* and 3*a*–3*d*,8*a*,8*b* which engages the conveyor bands 9 and the photosensitive material and terminates short of such side, the bearing units 10,11 do not interfere with movement of the conveyor bands 9 and the photosensitive material.

The advantages of the bearing structure according to the invention are not diminished when a conventional chain drive is connected with one end of each shaft 4,5. The type of drive employed has been found to be of secondary importance. Similarly, the bearing structure of the invention may be used with advantage regardless of whether the shafts 4,5 are fixed or rotatable, and regardless of whether the rollers 2*a*–2*d*,7*a*,7*b*,3*a*–3*d*,8*a*,8*b* are permanently fixed to the shafts 4,5, are permanently rotatable relative to the shafts 4,5, or are arranged to be selectively coupled to and uncoupled from the shafts 4,5.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

We claim:

1. An arrangement for processing, particularly wet processing, running lengths of photosensitive material such as photographic paper, comprising support means; at least one shaft having a pair of end portions; at least one roller on said shaft for guiding the running lengths of photosensitive material, said one roller being spaced from said end portions; a conveying band trained over said one roller; bearing means for said shaft, said bearing means comprising a bearing unit which is mounted on said support means and supports said shaft in the region of said one roller, and said end portions of said shaft being cantilevered; and a pair of additional rollers each of which is disposed on said shaft to a different side of said one roller, said additional rollers being free of conveyor bands, and all bearing support for said shaft being restricted to the region between said additional rollers.

2. The arrangement of claim 1, said support means having a lower portion, and said shaft being located in said lower portion; and wherein said support means includes a carrier disposed above said shaft, said bearing unit depending from said carrier.

3. The arrangement of claim 2, wherein said carrier is elongated and substantially parallels said shaft.

4. The arrangement of claim 3, said support means including a pair of walls each of which is generally perpendicular to said shaft and is located in the region of a respective end portion; and wherein said carrier is mounted on said walls.

5. The arrangement of claim 2, said bearing unit having a first section in the region of said shaft, and a second section extending from the respective first section towards said carrier; and wherein said bearing unit comprises a pair of strips, and the strips are in surface-to-surface engagement in said second section, the strips being bent in said first section to define a generally U-shaped element which receives said roller.

6. The arrangement of claim 1 wherein said support means is provided with a pair of grooves and each of said end portions is received in a respective groove.

7. The arrangement of claim 6, wherein said end portions are freely received in the respective grooves.

8. The arrangement of claim 1 wherein each of said additional rollers is mounted on one of said end portions.

9. The arrangement of claim 1, wherein said support means comprises a housing of a portable rack designed to be immersed in a processing bath for the lengths of photosensitive material.

10. The arrangement of claim 9, comprising drive means on said housing for rotatably driving said shaft.

11. The arrangement of claim 1, wherein said support means comprises a housing which accommodates at least one processing bath for the lengths of photosensitive material.

12. The arrangement of claim 1, further comprising another roller on said shaft between said additional rollers; and another conveyor band trained over said other roller, said bearing means including another bearing unit which is mounted on said support means and supports said shaft in the region of said other roller.

13. The arrangement of claim 12, said support means having an upper portion, and said shaft being located in said upper portion; and wherein each of said bearing units comprises a flange below said shaft projecting inwardly from said support means towards the respective roller, and a U-shaped portion fast with the respective flange and receiving the respective roller.

14. The arrangement of claim 13, wherein each of said U-shaped portions has a pair of upwardly extending arms and said arms are provided with registering openings which receive said shaft.

15. The arrangement of claim 14, said support means including a pair of walls each of which is generally perpendicular to said shaft and is located in the region of a respective end portion; and wherein each of said flanges is mounted on a respective wall.

16. The arrangement of claim 15, wherein of said additional rollers is disposed between each of said walls and an arm of the respective U-shaped portion.

17. The arrangement of claim 12, wherein said one and other rollers are substantially symmetrically arranged about a plane normal to said shaft and essentially bisecting said support means.

18. The arrangement of claim 17, wherein said additional rollers are substantially symmetrically arranged about said plane.

19. The arrangement of claim 1, further comprising a plurality of additional shafts on said support means; and at least one roller on each of said additional shafts for guiding the running lengths of photosensitive material, said shafts being arranged so as to define a meandering path for the photosensitive material.

20. The arrangement of claim 19, said support means having an upper portion and a lower portion; and wherein at least two of said shafts are located in said upper portion, at least one other shaft being located in said lower portion between the two shafts in said upper portion.

21. The arrangement of claim 20, wherein each shaft carves a pair of first rollers, and a plurality of second rollers arranged so that each of the first rollers is disposed between two of the second rollers, each of said shafts being supported by a pair of bearing units mounted on said support means, and each of said bearing units engaging the respective shaft in the region of a respective first roller.

22. The arrangement of claim 20, wherein more than two shafts are located in said upper portion and more than one shaft is located in said lower portion, each shaft in said lower portion being disposed between a respective pair of the shafts in said upper portion.

23. An arrangement for processing, particularly wet processing, running lengths of photosensitive material such as photographic paper, comprising support means; at least one shaft having a pair of end portions; at least one roller on said shaft for guiding the running lengths of photosensitive material, said one roller being spaced from said end portions a conveying band trained over said one roller; and bearing means for said shaft, said bearing means comprising a bearing unit which is mounted on said support means and supports said shaft in the region of said one roller, and said bearing unit including a U-shaped portion which receives said one roller, said end portions of said shaft being cantilevered.

24. The arrangement of claim 23, said band engaging one side of the said roller and said U-shaped portion including a pair of arms which extend from the other side of said roller towards said one side thereof.

25. The arrangement of claim 24 wherein each of said arms terminates short of said one side of said roller.

* * * * *